US005741401A

United States Patent [19]

Heinzmann

[11] Patent Number: 5,741,401

[45] Date of Patent: Apr. 21, 1998

[54] HEADBOX OF A PAPER MACHINE

[75] Inventor: Helmut Heinzmann, Böhmenkirch, Germany

[73] Assignee: Voith Sulzer Papiermaschinen GmbH, Heidenheim, Germany

[21] Appl. No.: 799,443

[22] Filed: Feb. 13, 1997

Related U.S. Application Data

[63] Continuation of Ser. No. 531,009, Sep. 20, 1995, abandoned.

[30] Foreign Application Priority Data

Sep. 20, 1994 [DE] Germany ..... 44 33 445.1

[51] Int. Cl.[6] ..... D21F 1/06

[52] U.S. Cl. ..... 162/216; 162/258; 162/343

[58] Field of Search ..... 162/336, 343, 162/259, 216, 258

[56] References Cited

U.S. PATENT DOCUMENTS

| | | | |
|---|---|---|---|
| 3,216,892 | 11/1965 | Wahlstrom et al. | 162/343 |
| 3,514,372 | 5/1970 | Boyce et al. | 162/343 |
| 3,652,392 | 3/1972 | Appel | 162/343 |
| 3,661,605 | 5/1972 | DeNoyer | 162/343 |
| 3,725,197 | 4/1973 | Dahl et al. | 162/343 |
| 3,791,918 | 2/1974 | Kostimies et al. | 162/343 |
| 3,843,470 | 10/1974 | Betley et al. | 162/343 |
| 3,939,037 | 2/1976 | Hill | 162/341 |
| 3,954,558 | 5/1976 | Egelhof | 162/336 |
| 4,104,116 | 8/1978 | Koskimies | 162/343 |
| 4,133,713 | 1/1979 | Chuang | 162/343 |
| 4,326,916 | 4/1982 | Flaig et al. | 162/344 |
| 4,504,360 | 3/1985 | Fujiwara | 162/343 |
| 4,566,945 | 1/1986 | Ewald et al. | 162/343 |
| 4,604,164 | 8/1986 | Fujiwara et al. | 162/343 |
| 4,687,548 | 8/1987 | Ilmoniemi et al. | 162/216 |
| 4,765,868 | 8/1988 | Fujiwara | 162/343 |
| 4,812,208 | 3/1989 | Yuasa et al. | 162/343 |
| 4,888,094 | 12/1989 | Weisshuhn et al. | 162/198 |
| 4,897,158 | 1/1990 | Weisshuhn et al. | 162/259 |
| 4,898,643 | 2/1990 | Weisshuhn et al. | 162/259 |
| 5,022,965 | 6/1991 | Pitkajarvi | 162/343 |
| 5,030,360 | 7/1991 | Nous | 162/258 |
| 5,110,416 | 5/1992 | Linsuri et al. | 162/343 |
| 5,183,537 | 2/1993 | Hergert et al. | 162/343 |
| 5,316,383 | 5/1994 | Begemann et al. | 366/160 |
| 5,603,807 | 2/1997 | Heinzmann | 162/343 |

FOREIGN PATENT DOCUMENTS

| | | | |
|---|---|---|---|
| 1 243 527 | 10/1988 | Canada . | |
| 0 211 607 | 2/1987 | European Pat. Off. . | |
| 462472 | 12/1991 | European Pat. Off. | 162/259 |
| 0 631 011 | 12/1994 | European Pat. Off. . | |
| 370 422 | 3/1923 | Germany . | |
| 15 61 686 | 12/1969 | Germany . | |
| 34 22 846 | 12/1984 | Germany . | |
| 35 35 849 | 4/1987 | Germany . | |
| 42 39 643 | 4/1993 | Germany . | |
| 42 11 291 | 10/1993 | Germany . | |

OTHER PUBLICATIONS

Bauer et al., "Über die Messung der Faserorientierung in einem Papierblatt mittels Laserstrahlung," *Wochenblatt Fur Papierfabrikation*, 1988, pp. 461–462, 464–466 and 468.

D. Egelhof Heidenheim, "Der Einfluss des Stoffauflaufes auf Asymmetriefehler im Papier," Sonderdruck aus Das Papier Nr. Jul. 1986, Seite 313–318, pp. 2–7.

Japanese Abstract No. 5–132885, Sep. 9, 1993, vol. 17/No. 499.

*Primary Examiner*—Karen M. Hastings

*Attorney, Agent, or Firm*—Marshall, O'Toole, Gerstein, Murray & Borun

[57] ABSTRACT

The invention concerns a headbox of a paper machine wherein an inlet region is provided along the entire width of the machine for introducing the pulp suspension, a discharge region is provided for distributing the pulp suspension along the width of at least one screen, and channels are provided between the inlet region and discharge region in which turbulence is produced in the pulp suspension (turbulence region). According to the invention, the turbulence region is formed with the aid of a number of channels, the cross-section of which, perpendicularly to the plane of flow, has an elongated form and may be variable.

18 Claims, 6 Drawing Sheets

HEADBOX OF A PAPER MACHINE

This is a continuation of U.S. application Ser. No. 08/531,009, filed Sept. 20, 1995, now abandoned.

BACKGROUND OF THE INVENTION

1. Field of the Invention

The invention is concerned with a headbox of a paper machine.

2. Brief Description of Related Technology

A problem in the production of paper with uniform structure and thickness and uniform fiber orientation over the entire machine width lies in the consistency distribution of the pulp suspension from which the paper is made. The pulp suspension contains long fibers that have a tendency to form flocks, as a result of which density differences occur in the paper web; in addition, the long fibers tend to align in the flow direction so that the manufactured paper web will have different tensile strengths in the machine direction and transverse direction, respectively. Satisfactory dispersion of the fibers is to be achieved by using turbulent flow.

Therefore, in order to avoid the formation of flocks and to avoid alignment of the fibers, headboxes with different turbulence inserts of various structures have been used.

U.S. Pat. No. 4,504,360 describes a headbox with a turbulence insert that consists essentially of plates of different thickness running along the machine width between the cover plate and the bottom plate of the headbox. The thinning and crowding of the plates and of the surfaces of the cover plate and the bottom plate are designed in such a way that the flow cross-section in the particular channel of the headbox under consideration decreases continuously and is the same along the width of the machine, so that a steady acceleration or deceleration of the pulp suspension is achieved. In this way, an attempt is made to separate the flocks present in the pulp suspension.

A disadvantage of this design is that adjustment of the headbox to different pulp compositions and machine speeds is possible only to a limited extent. Furthermore, it is a disadvantage that it is not possible to adapt the channels formed by the plates of the turbulence inserts to different throughputs along the width of the headbox in a predetermined manner.

DE-OS 1,561,686 describes a headbox for a paper machine with flow chambers, the boundary walls of which are discontinuous in order to produce turbulence. This publication also shows an embodiment with several channels with barriers that are provided in the flow path to produce turbulence. These embodiments have proven to be ineffective.

JP 5-132885 (A) describes a headbox with a flow channel, the flow bed of which has lateral faces in order to produce turbulence. This embodiment is unsatisfactory in practice.

U.S. Pat. No. 5,030,326 describes a headbox with a turbulence insert of conventional construction. As far as can be seen, this turbulence insert has a number of channels with circular cross-section. The terminal region of the discharge end also has turbulence-producing devices with wavy separating walls. However, these separating walls are not comparable to the conventional turbulence insert; they are too far downstream in the flow path to have the necessary effect.

SUMMARY OF THE INVENTION

It is an object of the invention to overcome one or more of the problems discussed above.

Accordingly, the invention provides a headbox for a paper machine with which uniformity of dispersion of paper fibers is improved and the mechanical properties of the produced paper web will be as uniform as possible in the respective transverse and longitudinal directions. Furthermore, it is possible to make adjustments corresponding to different paper machine speeds and fiber suspension properties across the width of the machine in a simple manner. According to the invention, a headbox of a paper machine includes a machine-wide flow chamber having an inlet and an outlet and a turbulence insert incorporated into the flow chamber. The insert includes a plurality of channels having boundary surface with turbulence-producing surface structure.

Further objects and advantages may be apparent to those skilled in the art from a review of the following detailed description, taken in conjunction with the drawings and the appended claims.

DETAILED DESCRIPTION OF THE INVENTION

Figure 1:
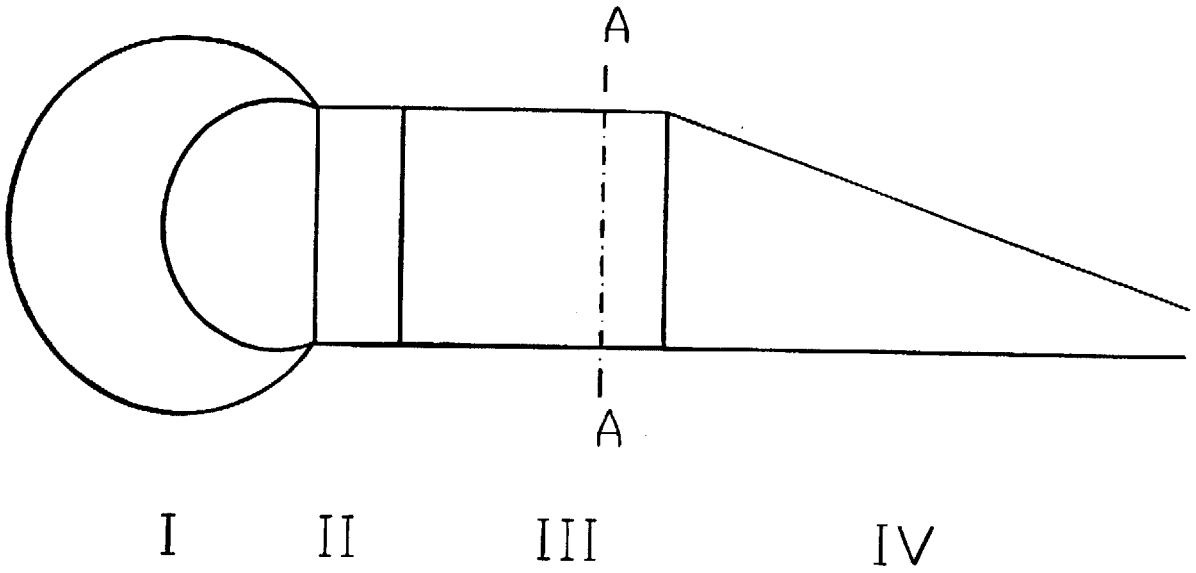
FIGS. 1–3 illustrate headboxes having turbulence regions according to the invention.

The invention provides a headbox of a paper machine, comprising a machine-wide flow chamber having an inlet and an outlet and a turbulence insert that can be incorporated into the flow chamber. The insert comprises a plurality of channels having boundary surfaces, each having a turbulence-producing surface structure wherein, viewed in a direction perpendicular to flow, each channel is at least twice as long as it is wide.

As a result, the dispersion of the paper fibers is improved, thus improving paper quality. In addition, a turbulence insert with channels according to the invention can be produced more easily than the turbulence inserts of the prior art, where the channels are formed from crude bundles.

According to one embodiment of the invention, the width of the channels and thus the cross-section of the individual channels can be changed. Change of the cross-section can be done, for example, by plates that can be shifted with respect to one another, especially when the plates have a wavy surface structure, so that when they are shifted along or perpendicularly to the direction of flow, sections of different acceleration and deceleration or turbulence are produced. Thus, according to the invention, the degree of turbulence can be adjusted, and the throughput can also be changed.

In another embodiment, individual adjustment of the channels is also possible, so that targeted adjustment of the area weight profile and fiber orientation transverse profile is possible.

According to another aspect of the invention, the multiple channels described above can be joined, individually or in blocks, directly to a multiple number of associated damping devices or preconnected mixing valves, which are fed with at least two different pulp suspension streams. It is especially advantageous to use mixing valves which provide the same total flow streams at different mixing ratios, as it is described, for example, in DE-OS 42 11 291.

According to the invention, a possible design of the surface of the channels corresponds to the designs of the valves according to DE-OS 42 39 643.

It is possible to arrange the channels leading to the discharge regions in various ways. For example, the channels may correspond approximately to a clearance height defined by the boundary surfaces and be disposed approximately vertically within the flow chamber. In another embodiment, the channels may be disposed at an angle to the vertical with the flow chamber.

The channels may be disposed horizontally, in which case they preferably extend over substantially one-half or less and highly preferably one-third to one-fourth of the width of the flow chamber.

Preferably, the channels are offset with respect to one another.

In one preferred embodiment, the channels are formed by tubes or plates disposed within the flow chamber. Preferably, the plates or tubes can be shifted in the direction of flow, and the distances between the plates or tubes may be variable.

Naturally, according to the invention, other embodiments are also possible, which are created by adaptations to the geometry of the headbox and then to improved discharge characteristics and uniform transverse profiles of the pulp jet and of the paper web.

Figure 8:
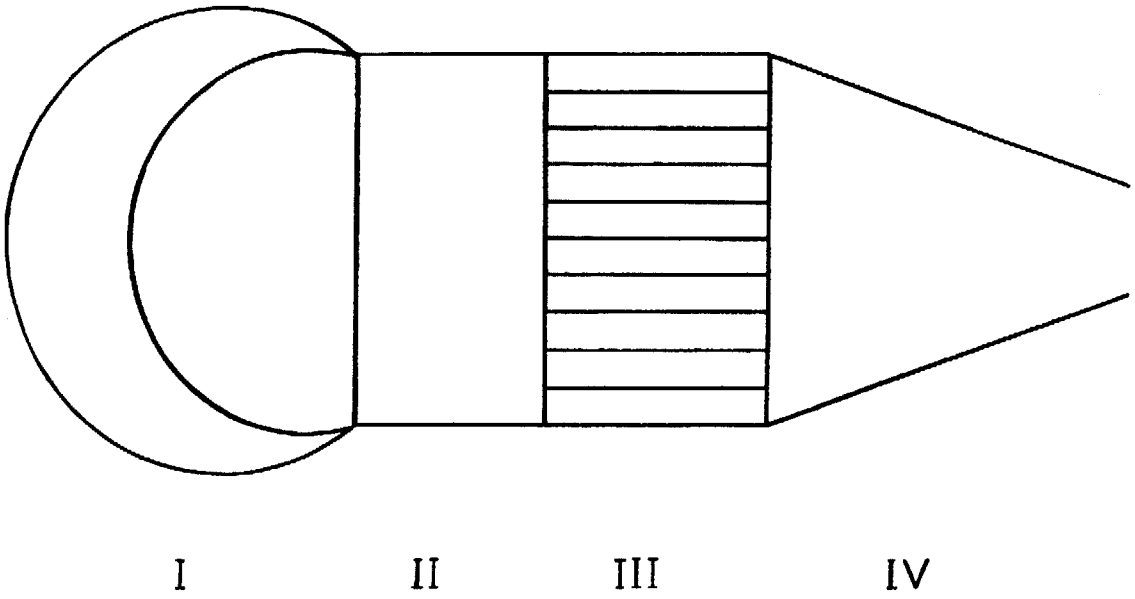
FIG. 8 PRIOR ART
FIGS. 8 and 9 illustrate headboxes according to the prior art.

With reference to the drawings, FIG. 8 is a longitudinal schematic sectional view through the structure of a conventional headbox with four regions, i.e., a pulp inlet I, a prechamber II, a turbulence region III, and a discharge region IV. In this case, the introduction of the pulp is carried out in the form of a paraboloidal transverse distribution tube I, from which the pulp suspension is introduced into the prechamber II and then through a turbulence insert in the region III comprising a plurality tubular channels, to the discharge region IV.

Figure 9:
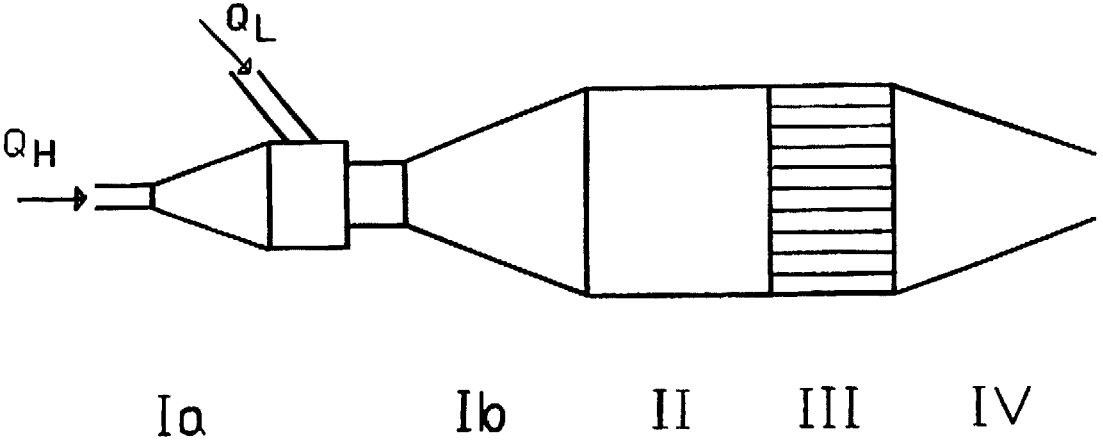
FIG. 9 PRIOR ART

A variation of the headbox of FIG. 8 is represented in FIG. 9. Here, the pulp is introduced to the prechamber II through a number of mixers Ia and a downstream diffuser Ib. Pulp is introduced to the mixes Ia in two streams $Q_H$ and $Q_L$. The prechamber II follows the conventional structure of a headbox with a turbulence region III and a discharge region IV.

In FIG. 8, the transverse profile of the paper web can be influenced only by adjustment of a diaphragm (not shown) at the end of the discharge region IV, while in FIG. 9 this is done by the upstream mixer Ia, which produces a predetermined influence on the local density and, when designed appropriately, also makes it possible to control the proportional amount of the total suspension stream $Q_H+Q_L$. In any case, in the headboxes of FIGS. 8 and 9, adaptation to different throughputs is not possible.

Figure 5:
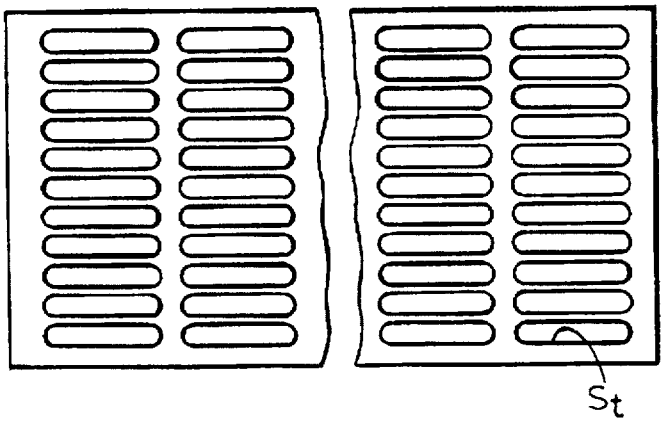
Figure 6:
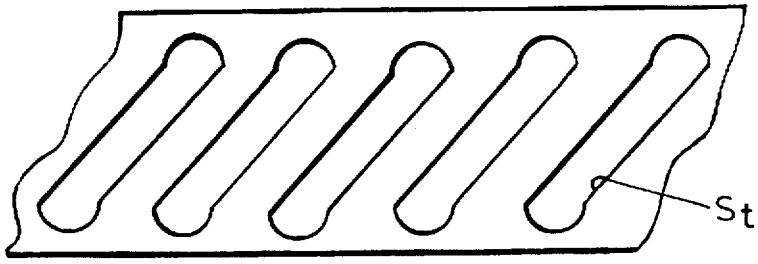

FIGS. 1 and 4–6 show a headbox of the invention including a conventional pulp inlet I, a conventional prechamber II, and a conventional discharge region IV. A turbulence region III according to the invention comprises a number of long channels (best seen in FIGS. 4 through 6) disposed transversely to the direction of the flow, wherein the cross-sections of the channels are adjustable. Possible arrangements of the channels relative to one another are those shown in FIGS. 4–6, which show a cross-section taken along line A—A through the turbulence region III. FIGS. 5 and 6 also indicate a turbulence-producing surface structure S.

In the inventive embodiment of FIG. 1, it is also possible to adjust the cross-sections of the channels individually, so that control of the degree of turbulence and of the throughput in various sections of the flow chamber is possible. If, in this case, adjustment of a diaphragm in the discharge region is also provided, then this embodiment provides the best control of different throughputs and simultaneous control of the transverse profile of the produced paper web with regard to weight, fiber orientation and, by influencing the degree of turbulence, also with regard to the flockiness of the paper web produced.

Figure 2:
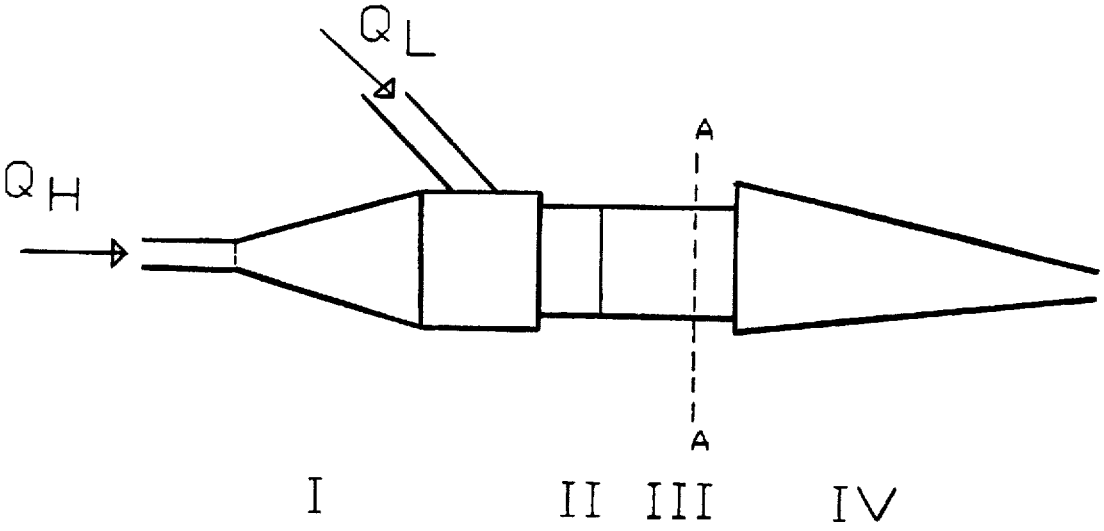

FIG. 2 shows another embodiment of a headbox of the invention, differing from the embodiment of FIG. 1 in that the pulp inlet region I of the headbox comprises a number of mixers to which two suspension streams $Q_H$ and $Q_L$ are introduced, and then combined to a total stream. In this embodiment, a special advantage lies in the fact that, on the one hand, controlled pulp suspension streams can be introduced to the mixers, which in turn lead to locally adjustable volume streams with adjustable density and/or to sectional total volume streams; on the other hand, due to the use of adjustable cross-sections in the turbulence region II, optimal adaptation to the different pulp suspension throughputs through the headbox and thus to large band width of paper thicknesses or machine velocities is possible. Optionally, it is also possible to assign a number of channels to be fed to each mixer, so that each mixer influences a "packet" of channels and thus influences the pulp density or amount of suspension in the corresponding section of the machine. The allocation can provide horizontal or vertical packets, or a combination of the two, as a result of which both individual sections, with regard to width as well as individual layers with reference to the height of the pulp jets, can be influenced.

Figure 3:
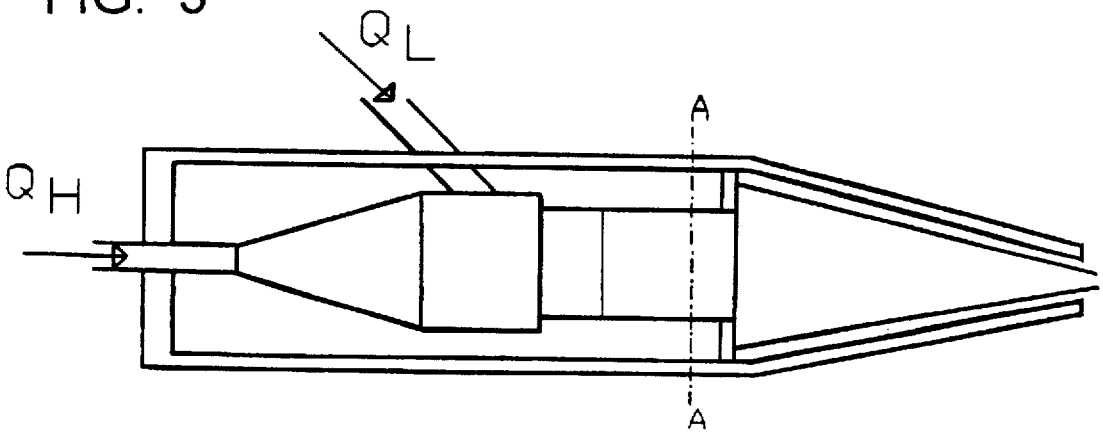
Figure 4:
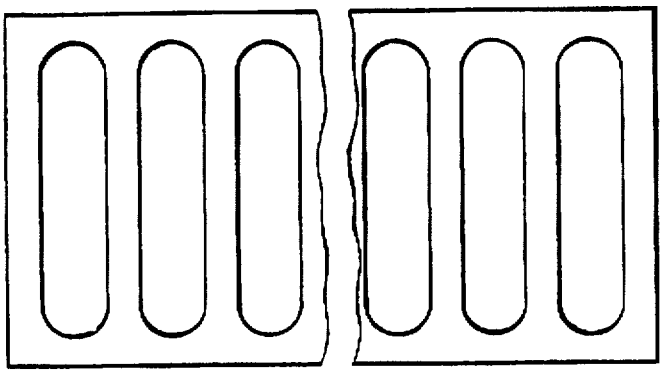
FIGS. 4—6 illustrate cross-sections of turbulence regions taken along lines A—A of FIGS. 1–3 respectively.

FIG. 3 shows an embodiment of the headbox in which the elements shown in FIG. 2 are integrated into a stabilizing housing, as a result of which advantages can arise with regard to stability of the headbox.

With respect to FIGS. 1–3, the prechamber II is not absolutely necessary if the design of the suspension inlet in section I is favorable from the point of view of flow.

Figure 7:
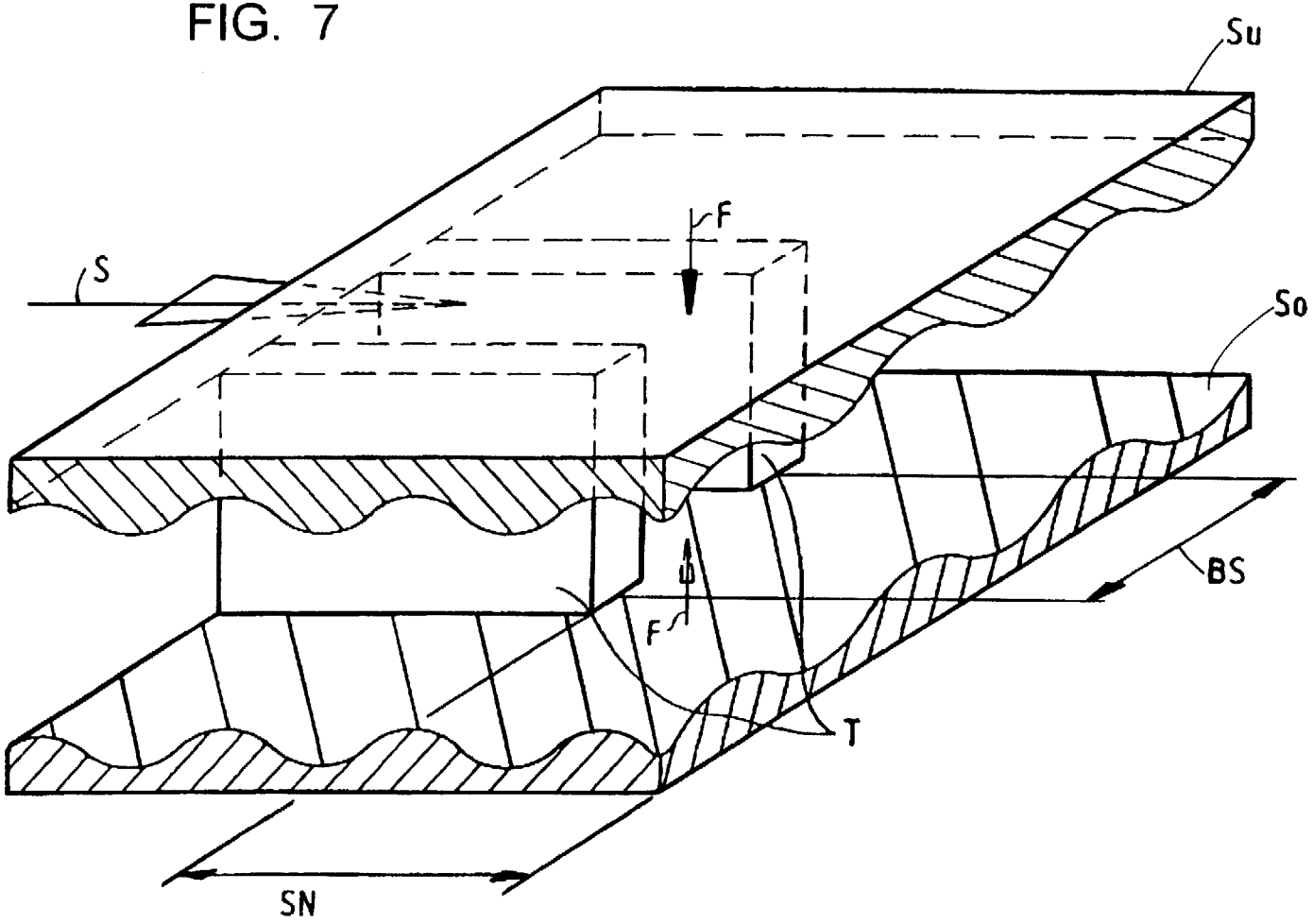
FIG. 7 is a perspective view of a turbulence region of the invention.

FIG. 7 is a perspective view of another embodiment of the turbulence region III of a headbox according to the invention. The flow direction of the pulp suspension is shown by an arrow S. In the embodiment shown, the turbulence region of the headbox is divided along the width of the machine into sections with a section width $B_s$ by separating walls T extending between an upper structural plate $S_u$ and a lower structural plate $S_o$. At the same time, the walls T can serve as stays or supports between the structural plates $S_u$ and $S_o$. The plates $S_u$ and $S_o$ are provided with surface structures on their sides facing the suspension to produce turbulence in the flowing pulp suspension. In order to avoid markings in the paper web by the separating walls, it may be necessary to provide a post-run section $S_N$. Furthermore, it may be advantageous to have separating walls that end in a tip instead of those with blunt ends.

Those skilled in the art will recognize that the headbox of the invention may form a useful element of a multilayer headbox.

I claim:

1. Headbox of a paper machine, comprising:

a flow chamber having a width equal to a width of the paper machine, an inlet and an outlet region and a turbulence insert incorporated into the flow chamber defining a turbulence region disposed upstream from said outlet region with respect to a direction of flow of pulp suspension through the headbox, said insert comprising at least one row of channels, said row extending along the flow chamber width, each of the channels in said row of channels defined by at least one boundary surface having turbulence-producing surface formations extending along an entire length of the insert with respect to the direction of flow of pulp suspension through the headbox and wherein, when viewing a cross-section of the turbulence insert, said cross-section cut in a direction perpendicular to the flow of pulp suspension through the headbox, each said channel of said at least one row of channels has a shorter dimension and a longer dimension, the longer dimension being at least twice as large as the shorter dimension, an average cross-section of each channel of said at least one row of channels remaining substantially constant along the entire length of the insert.

2. Headbox of claim 1, wherein the channels correspond approximately to a clearance height defined by the turbulence region of the flow chamber and are approximately vertical.

3. Headbox of claim 1, wherein the channels are at an angle to the vertical.

4. Headbox of claim 1, wherein the channels are horizontal and each channel extends over one-half or less of the flow chamber width.

5. Headbox of claim 4, wherein the channels are horizontal and each channel extends over one-third to one-fourth of the flow chamber width.

6. Headbox of claim 1, wherein the channels are offset with respect to one another.

7. Headbox of claim 1, wherein the channels are at least in part defined by one of a plurality of plates and a plurality of tubes.

8. Headbox of claim 7, further comprising means for shifting said one of a plurality of plates and a plurality of tubes in the direction of flow of the pulp suspension through the headbox.

9. Headbox of claim 7, wherein the one of a plurality of plates and a plurality of tubes is a plurality of plates and further comprising means for varying distances between the plates.

10. Headbox of claim 1, wherein the pulp suspension is introduced into the headbox through a plurality of inlet lines distributed over the width of the machine.

11. Headbox of claim 10, wherein a single channel is assigned to each inlet line in the turbulence region.

12. Headbox of claim 10, wherein several neighboring channels in the turbulence region are assigned to each inlet line.

13. Headbox of claim 10, wherein a damping device is connected upstream of at least one inlet line.

14. Headbox of claim 10, wherein a mixing valve is connected upstream of at least one inlet line.

15. Headbox of claim 14, comprising at least two conduits, one conduit for each of at least two pulp suspension streams with different properties with regard to composition and/or throughput amount for introducing the at least two pulp suspension streams to said mixing valve.

16. A multilayer headbox comprising a headbox of claim 1.

17. A method of varying turbulence of pulp flowing through a paper making machine equally across a width of the machine, in response to varying paper machine speeds and fiber suspension properties, said method comprising:

providing a turbulence insert for a flow chamber of the headbox, the flow chamber having a width equal to a width of the paper machine, an inlet and an outlet region, the turbulence insert being incorporated into the flow chamber and defining a turbulence region disposed upstream from said outlet region with respect to a direction of flow of pulp suspension through the headbox, said insert comprising at least one row of channels, said row extending across the flow chamber width, each of the channels in said row of channels defined by at least one boundary surface having turbulence-producing surface formations extending along an entire length of the insert with respect to the direction of flow of pulp suspension through the headbox and wherein, when viewing a cross-section of the turbulence insert, said cross-section cut in a direction perpendicular to the flow of pulp suspension through the headbox, each said channel of said at least one row of channels has a shorter dimension and a longer dimension, the longer dimension being at least twice as large as the shorter dimension, an average cross-section of each channel of said at least one row of channels remaining substantially constant along the entire length of the insert;

adjusting distances between the boundary surfaces of all of the channels in the at least one row of channels to modify a degree of turbulence in each of the channels.

18. A method of targeted adjustment of area weight profile and fiber orientation transverse profile of paper made by flowing pulp through a head box of a paper making machine, said method comprising:

providing a turbulence insert for a flow chamber of the headbox, the flow chamber having a width equal to a width of the paper machine, an inlet and an outlet region, the turbulence insert being incorporated into the flow chamber and defining a turbulence region disposed upstream from said outlet region with respect to a direction of flow of pulp suspension through the headbox, said insert comprising at least one row of channels, said row extending across the flow chamber width, each of the channels in said row of channels defined by at least one boundary surface having turbulence-producing surface formations extending along an entire length of the insert with respect to the direction of flow of pulp suspension through the headbox and wherein, when viewing a cross-section of the turbulence insert, said cross-section cut in a direction perpendicular to the flow of pulp suspension through the headbox, each said channel of said at least one row of channels has a shorter dimension and a longer dimension, the longer dimension being at least twice as large as the shorter dimension, an average cross-section of each channel of said at least one row of channels remaining substantially constant along the entire length of the insert;

varying a degree of turbulence in at least one channel by adjusting the distance between boundary surfaces defining the channel.

* * * * *